United States Patent [19]

Matsuzaki

[11] 4,344,309

[45] Aug. 17, 1982

[54] PROCESS FOR PREVENTING GROWTH OF FISHTAILS DURING SLABBING

[75] Inventor: Minoru Matsuzaki, Chiba, Japan

[73] Assignee: Kawasaki Steel Corporation, Hyogo, Japan

[21] Appl. No.: 186,750

[22] Filed: Sep. 12, 1980

Related U.S. Application Data

[63] Continuation-in-part of Ser. No. 953,170, Oct. 20, 1978, abandoned.

[51] Int. Cl.[3] ..... B21B 1/00

[52] U.S. Cl. ..... 72/199; 72/366; 72/226

[58] Field of Search ..... 72/199, 226, 203, 206, 72/229, 240, 365, 366

[56] References Cited

U.S. PATENT DOCUMENTS

| | | | |
|---|---|---|---|
| 1,603,518 | 10/1926 | Coates | 72/366 |
| 3,606,785 | 9/1971 | Olsson | 29/526.3 |

FOREIGN PATENT DOCUMENTS

| | | | |
|---|---|---|---|
| 52-66860 | 6/1977 | Japan | 72/366 |
| 54-51946 | 4/1979 | Japan | 72/203 |
| 54-123553 | 9/1979 | Japan | 72/366 |
| 55-10317 | 1/1980 | Japan | 72/365 |
| 55-10363 | 1/1980 | Japan | 72/206 |
| 55-70403 | 5/1980 | Japan | 72/366 |
| 596301 | 3/1978 | U.S.S.R. | 72/199 |

*Primary Examiner*—Lowell A. Larson
*Attorney, Agent, or Firm*—Koda and Androlia

[57] ABSTRACT

The present invention is a process wherein: the process includes a method during slabbing, in which, recesses in the thicknesswise direction are formed on a pair of opposite surfaces at each end of the top and bottom of said steel ingot, subsequently, the central portions which have not been rolled, are rolled to the depth of said recesses, then, recesses in the widthwise direction are formed at the same end as described above, next, the central portions, which have not been rolled, are rolled to the depth of said recess in the widthwise direction; and, when the thicknesswise reduction value is $\Delta H_T$ and the widthwise reduction value is $\Delta H_W$ in said thicknesswise and widthwise reduction rollings, $\Delta H_W/\Delta Ht$ is regulated to 0.40~0.65 in a region where the material has a comparatively large thickness and the side profile of the material presents a double barrelling, and $\Delta H_W/\Delta H_T$ is regulated to 0.3 or less in a region where the thickness of the material has a comparatively small thickness and the side profile of the material presents a single barrelling; whereby fishtails are prevented from growing so that crop loss consisting of fishtails and double-plate shaped overlaps can be reduced, thereby improving the rolling yield to a considerable extent.

4 Claims, 19 Drawing Figures

PROCESS FOR PREVENTING GROWTH OF FISHTAILS DURING SLABBING

This is a continuation-in-part application of Ser. No. 953,170, filed on Oct. 20, 1978 now abandoned.

BACKGROUND OF THE INVENTION

1. Field of the Invention

This invention relates to a process for preventing growth of fishtails during slabbing, and more particularly to a method of reducing crop loss caused by the growth of fishtails produced at longitudinally opposite end portions of the top and bottom of a material to be rolled during slabbing.

2. Description of the Prior Art

Most of steel ingots, which have been cast in a steel works, are charged into a soaking pit as in a hot state, and slabbing-rolled to provide slabs and blooms.

During this slabbing, at the opposite end portions of the top and bottom of the steel ingot, there are grown fishtails 2 as shown in FIG. 1 and also overlaps 4 each consisting of an upper and a lower sheets, thus resulting in crop loss. Since the crops are shorn off to provide a good product, the amount of shorn-off crops adversely affects the yield of slabbing to a considerable extent. Hence, there have heretofore been proposed various methods for preventing the fishtails and overlaps from growing.

As one of the method of preventing fishtails from growing, there has been known a method wherein a strong reduction for reducing the width of a slab, which is a so-called edging, is practised at a stage where the thickness of the slab in cross section becomes fairly thin. However, during slabbing, there has generally been effected a comparatively strong reduction during a first pass for the purpose of removing scales off the surfaces of the steel ingot. Since the beginning of growth of fishtails during this first pass considerably adversely affects the final shapes of crops at the end of rolling, the conventional method, wherein a strong edging is effected at the final stage of rolling, is not effective in preventing the fishtails from growing.

On the other hand, although the reduction of the overlaps is mostly achieved by the method of preventing fishtails from growing, it is deemed preferable that, in rolling the steel ingot in the thicknesswise direction thereof, both the reduction value and the reduction ratio are increased per pass. However, as for the reduction value per pass, generally restrictions are placed on the adoptable reduction value due to the conditions of the limits imposed on the bite-in angle, torque and load to be applied during rolling, varying from the capacity of the rolling mill, the deformability of the material and the like.

From the reasons as described above, no radical countermeasures for reducing overlaps have been taken so far.

Consequently, in the present circumstances, there has not been adopted any effective method for reducing crop loss at the opposite ends of the steel ingot, which is caused by the growth of fishtails and overlaps during slabbing.

SUMMARY OF THE INVENTION

The present invention has been developed to obviate the disadvantages in the method of preventing fishtails from growing to reduce crop loss in slabbing of the prior art and has as its object the provision of a very effective method of preventing fishtails from growing.

The technical gist of the present invention resides in "a method of preventing fishtails from growing during slabbing of a steel ingot by a reversing rolling mill, including a process of forming recesses in the thicknesswise and widthwise directions by means of rolling rolls on a pair of opposite surfaces at least at each end of the top and bottom of said steel ingot, wherein said method further includes a method of forming recesses in the thicknesswise and widthwise directions, and the ratio between the widthwise reduction value and the thicknesswise reduction value for forming the recesses at the forward and rear end portions is regulated to 0.40~0.65 in a region where the side profile of the material due to the thicknesswise reduction presents a double barrelling and the value in a region where the side profile presents a single barrelling is regulated to 0.3 or less."

DETAILED DESCRIPTION OF PREFERRED EMBODIMENTS

The characteristics of slabbing resides in that the diameters of working rolls are small against the thickness of the material to the rolled as compared with other rollings such as hot rolling of a slab.

From this reason, plastic deformation behavior of opposite ends of slab in each of ten-odd passes from the initiation to the end of the rolling of the ingot is three-dimension and very complex.

Therefore, prior to description of the present application, description will be given of the process of formation of crops due to the growth of fishtails.

As described above, slabbing is characterized in that the diameters of working rolls are small with respect to the thickness of the material to be rolled as compared with other rollings such as hot rolling, and restrictions are placed on the adoptable reduction value and reduction ratio due to the conditions of the limits imposed on the bite-in angle, torque and load to be applied during rolling.

Figure 1:
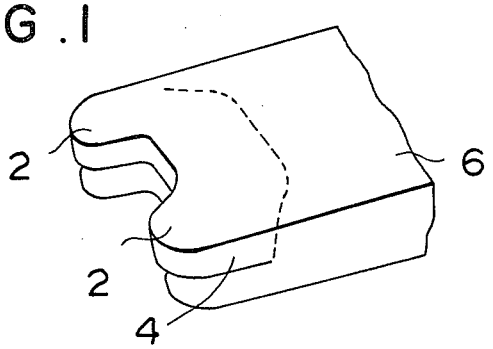
FIG. 1 is a perspective view showing crop loss caused by fishtails and overlaps produced at opposite end portions of the material in the longitudinal direction thereof during slabbing of the prior art.
Figure 2:
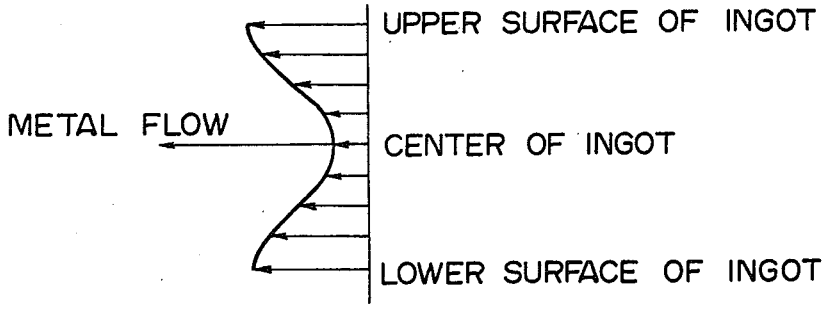
FIG. 2 is a schematic sectional view showing the values of metal flow in the thicknesswise direction of the material during slabbing.

From the abovedescribed reasons, it is difficult that both the surfaces and the central portion of the material to be rolled are uniformly plastically deformed, and metal flows in the surface layers become higher than those in the central portion as shown in FIG. 2.

In a reversing rolling mill, the bite-in side and the bite-out side alternate with each other. To state the movement of the metal due to the reduction in each pass, at the bite-out side, the metal gathered together at each end of pass flows in large quantities to the end portions so as to cause the fishtails and overlaps to grow and, at the bite-in side also, the fishtails and overlaps to grow as the passes progress.

Figure 3A:
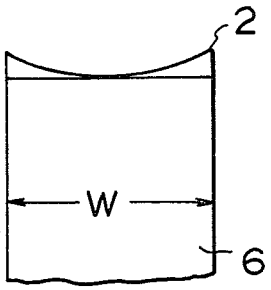
FIGS. 3A and 3B show fishtails produced during the widthwise (W) reduction, FIG. 3A being a plan view showing the shape of the fishtails immediately after being produced, and FIG. 3B being a schematic plan view showing the changes of the fishtails in shape during the widthwise (W) reduction by means of the edger rolls.
Figure 3B:
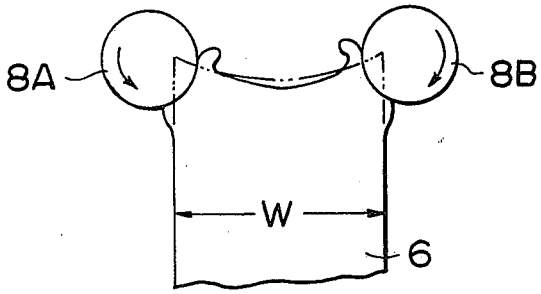

More particularly, in the case fishtails 2 are formed at opposite ends of a slab as shown in FIG. 3A, if the material 4 to be rolled is subjected to widthwise reduction between edger rolls 8 (8A, 8B), then the fishtails 2 turn inwardly in the widthwise direction as shown in FIG. 3B.

Figure 4A:
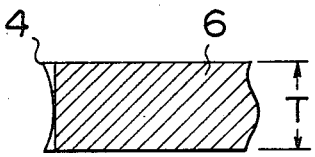
FIGS. 4A and 4B show overlaps produced during the thicknesswise (T) reduction, FIG. 4A being a sectional view showing the shapes of overlaps immediately after being produced, and FIG. 4B being a schematic sectional view showing the changes in the overlaps during the thicknesswise (T) reduction by means of the horizontal rolls.
Figure 4B:
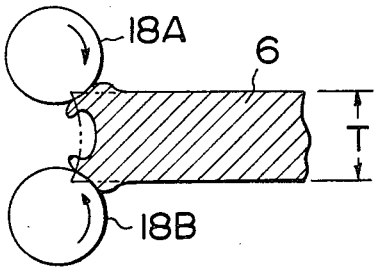

Likewise, in the case overlaps 4 are formed at opposite ends of a slab as shown in FIGS. 4A and 4B, if the material 6 is subjected to thicknesswise reduction between horizontal rolls 18 (18A, 18B), then the overlaps 4 turn inwardly in the thicknesswise direction. As the rolling progresses, such movements of metal as described above are repeated to cause the fishtails 2 and overlaps 4 to progressively grow so as to finally be formed into crops. The resultant crops are shorn to cause a loss. It is very important to reduce crop loss as described above in order to improve the yield of steel ingot in the slabbing.

Description will hereunder be given of the method of preventing fishtails from growing to reduce crop loss according to the present invention with reference to the attached figures.

The present invention includes a process of forming recesses in the thicknesswise and widthwise directions by means of rolling rolls on a pair of opposite surfaces at least at each end of the top and bottom of the steel ingot.

Description will now be given of the method of rolling to form recesses in the thicknesswise direction.

Figure 5A:
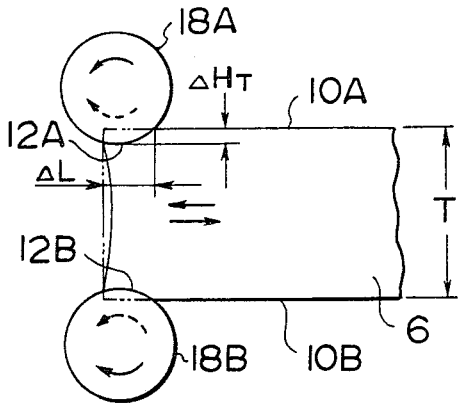
FIGS. 5A, 5B and 5C show the rolling process according to the present invention, FIG. 5A being a schematic sectional view showing the recesses formed at one end of the material by means of the horizontal rolls, FIG. 5B being a schematic sectional view showing the state where the central portion is projected by forming the recesses by several times of bite and reverse rollings, thus eliminating the overlaps, and FIG. 5C being a perspective view showing the spread width in the forward portion at the same time as FIG. 5B.

As shown in FIG. 5A, opposite surfaces 10A and 10B of the top and bottom portions in the thicknesswise direction are subjected to bite and reverse rolling by horizontal rolls 18 (18A, 18B) to form recesses 12 (12A, 12B).

Figure 5B:
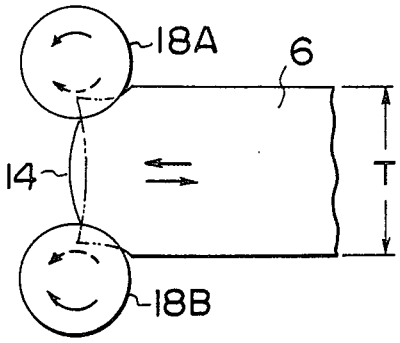
Figure 5C:
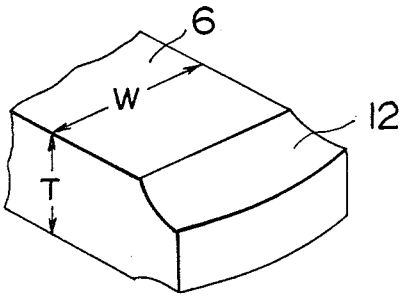

Only one time of bite and reverse rolling forms a recess having a tendency of overlapping at the forward end of the steel ingot as shown in FIG. 5A. However, if formings of the recesses 12 by bite and reverse rollings are repeated several times, then the thicknesswise central portion 14 at the forward end projects and the tendency of overlapping disappears as shown in FIG. 5B. As shown in FIG. 5C, the previously recessed portion has a tendency of width spread and convex shape in the widthwise direction. Such deforming behavior at the forward end as described above has been clarified by the studies conducted on the actual operation of the present inventor.

Description will hereunder be given of dimensions of recesses formed by the rolling rolls.

The depth of a recess finally formed after several times of bite and reverse rolling i.e., $\Delta H_T$ shown in FIG. 5A is about 50 mm, varying depending on the capacity of a rolling mill, the deformability of a material and the like. The optimum value of $\Delta H_T$ can be desirably determined from the relationship of the widthwise reduction value, i.e., $\Delta H_w$ which will hereinafter be described.

Figure 6A:
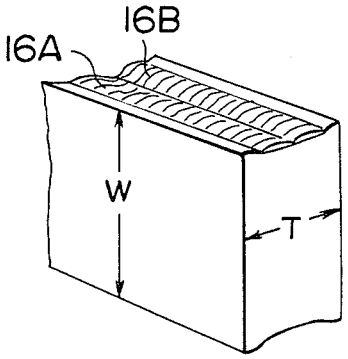
FIGS. 6A and 6B are perspective views showing the double barrelling and single barrelling produced during the rolling process, respectively.
Figure 6B:
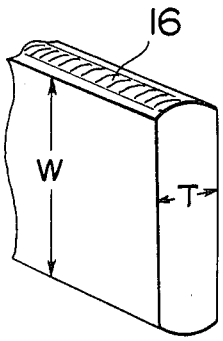

The length $\Delta L$ of a recess finally formed after several times of bite and reverse rolling may preferably be about 200~400 mm based on the results obtained through the studies conducted by the present inventor. The reason is that, in the case a material having a large thickness such as a steel ingot is rolled into a slab, in general the rolling in the thicknesswise direction accompanies width spread. The side profile of the slab at that time, in a region where the thickness of the slab is large, is formed into a double barrelling having two ridges 16A, 16B as shown in FIG. 6A because metal flow in the widthwise direction is large in quantities, and, in a region where the thickness of the slab becomes small, is formed into a single barrelling having a ridge 16 as shown in FIG. 6B.

Figure 7:
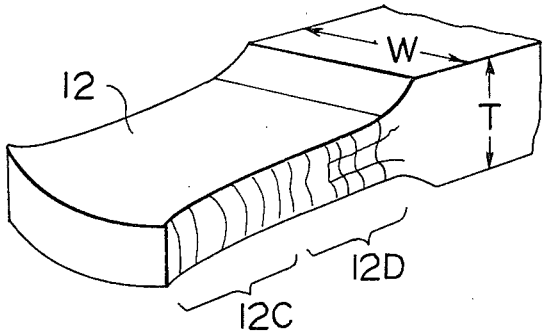
FIG. 7 is a perspective view showing the double barrelling when the length of recesses thus formed is excessively long.

Therefore, if the length of the recess 12 in the lengthwise direction of a material 6 to be rolled is extended to a length more than necessary, then the forward end 12C of the recess 12 is formed into a single barrelling as shown in FIG. 7, while the rear end 12D becomes a double barrelling and finally, such a disadvantage is presented that the side profile is turned into two plates-like shape similar to the overlap in the thicknesswise rolling. In this case, if the widthwise reduction is applied to the material before the material is formed into an extreme double barrelling shape, then the abovedescribed disadvantage can be obviated. In this case, however, metal flows take place which develop fishtails at the crop ends, whereby the final effect of reducing crop loss is weakened, thus presenting another disadvantage. Extension of the length of the recess is not preferable because it adversely affects the reduction efficiency.

As described above, in forming the recesses in the thicknesswise direction, the resultant side profile may preferably be formed into a single barrelling. To achieve this aim, the length of the recess $\Delta L$ should be limited to within a range of a suitable predetermined value, which is 200~400 mm according to the results of the experiments conducted by the present inventor.

Figure 8:
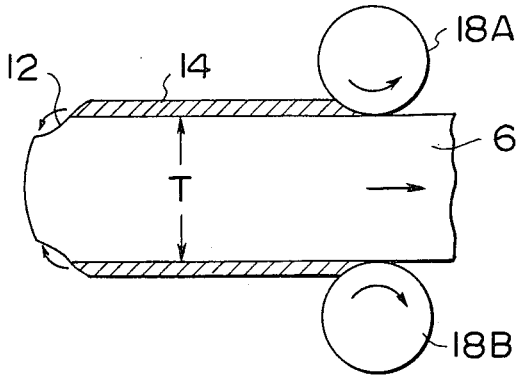
FIG. 8 is a schematic sectional view showing the state where the recesses formed at the forward end portions of the material absorb the metal flows caused by the subsequent rolling during slabbing according to the present invention.

Formation of the recesses 12 according to the present invention makes it possible that the recesses thus formed can absorb metal flows 14 as shown in FIG. 8 so as to prevent metal flows toward crop ends, which would otherwise be caused by subsequent rolling. Thus, the method according to the present invention makes it possible to minimize the overlaps also as shown in FIG. 4A.

Figure 9A:
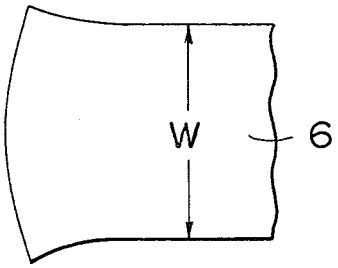
FIGS. 9A and 9B show the change at the forward end portion of the material due to the recesses formed in the widthwise (W) direction thereof, FIG. 9A being a plan view showing the state where the forward end portion is expanded due to the recess forming in the thicknesswise (T) direction and the thicknesswise reduction during the previous process immediately before the recesses in the widthwise (W) direction are formed, and FIG. 9B being a plan view showing the state where the recesses are formed on the material shown in FIG. 9A by means of the edger rolls to eliminate the raised portion at the forward end, thus obtaining the straight-lined shape.
Figure 9B:
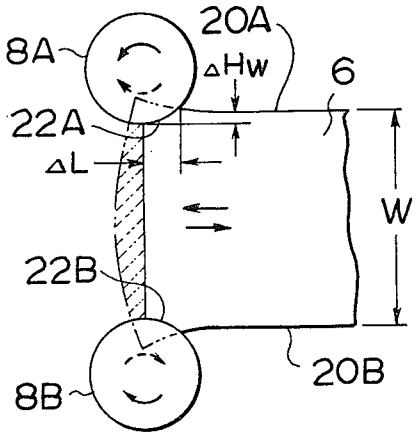

Description will now be given of the method of rolling for forming recesses in the widthwise direction. FIGS. 9A and 9B show the recesses formed in the widthwise direction (W). The forward end portion of the slab, at which the recesses are formed on the opposite surfaces in the thicknesswise direction (T) as shown in FIG. 9A, is expanded into a forwardly fanned-out shape in plan view with the forward end in the widthwise direction being convex. This plan view corresponds to the shape shown in FIG. 5C. When recesses 22 (22A, 22B) are formed on the opposite surfaces 20 (20A, 20B) in the widthwise direction (W) at one end of the slab as shown in FIG. 9B, the forward end of the slab recedes in accordance with the values of formation of recesses in the widthwise direction (W). In this case, because the forward end of the slab has been formed into a convex shape as shown in FIG. 9A due to formation of the recesses 12 in the thicknesswise direction, the growth of the fishtails can be minimized to an extreme extent, so that the hatched convex portion shown in FIG. 9B can be eliminated to present a straight-lined shape. Furthermore, metal flow generated during the subsequent rolling can be absorbed by the recesses 22 in the widthwise direction (W) in the same manner as metal flow by the recesses in the thicknesswise direction (T) as shown in FIG. 8.

As described above, according to the invention, the recesses in the thicknesswise and widthwise directions are formed on a pair of opposite surfaces at least at each end of the top and bottom of the steel ingot, and thereafter, ordinary slabbing is effected on the pair of opposite surfaces, respectively, so that fishtails can be prevented from growing, thereby enabling to obtain an outstanding advantage in the reduction of crop loss.

In connection therewith, the present inventor found from the results of many experiments conducted by him that in order to effectively prevent the fishtails from growing, in forming the recesses, it is necessary to form the recesses in the thicknesswise direction first and those in the widthwise direction last.

Upon studying effective combinations of the recesses formed in the thicknesswise and widthwise directions in the slabbing wherein thicknesswise and widthwise reductions repeatedly alternate with each other, the present inventor found that the recesses are formed in the thicknesswise direction first and those in the widthwise direction last in accordance with the following formulae: in a region where the thickness of the steel ingot is comparatively thick and the side profile of the steel ingot due to the thicknesswise reduction presents a double barrelling, $$\Delta H_w/\Delta H_T = 0.40 \sim 0.65 \quad (1)$$

in a region where the thickness of the steel ingot is comparatively thin and the side profile presents a single barrelling, $$\Delta H_w/\Delta H_T \leqq 0.3 \quad (2)$$

in both the formulae (1) and (2), $\Delta H_w$: Depth of recesses formed in the opposite surfaces in the widthwise direction, and $\Delta H_T$: Depth of recesses formed in the opposite surfaces in the thicknesswise direction, and thereafter, ordinary widthwise reduction is effected, thereby enabling to further reduce crop loss regardless of what the size of slab rolled out of the steel ingot is.

During slabbing a steel ingot, at the initial stage of rolling where the thickness of a material to be rolled is comparatively large, the side profile of the material is formed into a double barrelling as shown in FIG. 6A, when the thickness of the material becomes small as the rolling progresses, the side profile of the material is formed into a single barrelling as shown in FIG. 6B, and the border in thickness therebetween is generally from 450~500 mm, slightly varying from the size of the steel ingot.

Figure 10:
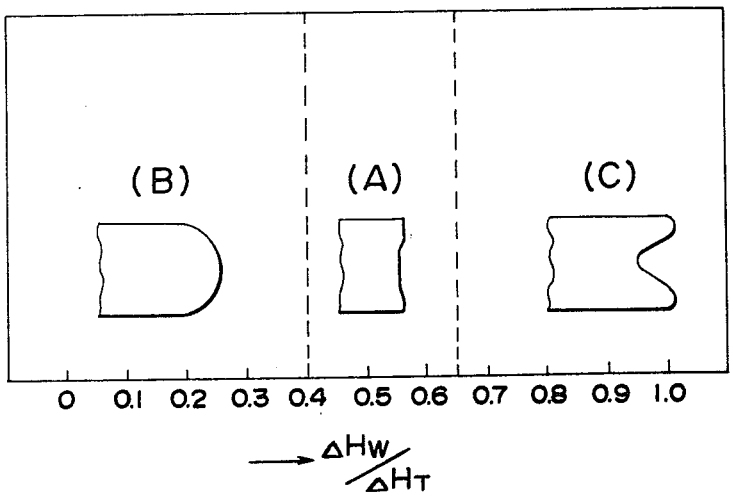
FIG. 10 is an explanatory view showing the relationship between $\Delta H_w/\Delta H_T$ and the planar shape in a region where the side profile of the material due to the thicknesswise reduction presents the double barrelling.

The following is the reason for that, according to the present invention, $\Delta H_w/\Delta H_T = 0.40 \sim 0.65$ is defined for the region of thickness where the double barrelling is presented. Namely, according to the results of studies by the present inventor, in the case $\Delta H_w/\Delta H_T$ is less than 0.40 as shown in FIG. 10, the opposite ends of the material project like tongues to form the so-called "tongues" as shown in (B) of FIG. 10, thus resulting in increased crop loss. In contrast with this, in the case $\Delta H_w/\Delta H_T$ exceeds 0.65, fishtails are grown at the opposite ends of the material as shown in (C) of FIG. 10, thereby resulting in increased crop loss. However, it was found that in the case $\Delta H_w/\Delta H_T$ is within the range from 0.40~0.65, the opposite ends of the material in plan view present square shapes as shown in (A) of FIG. 10, thus nearly eliminating the crop to be shorn.

Figure 12:
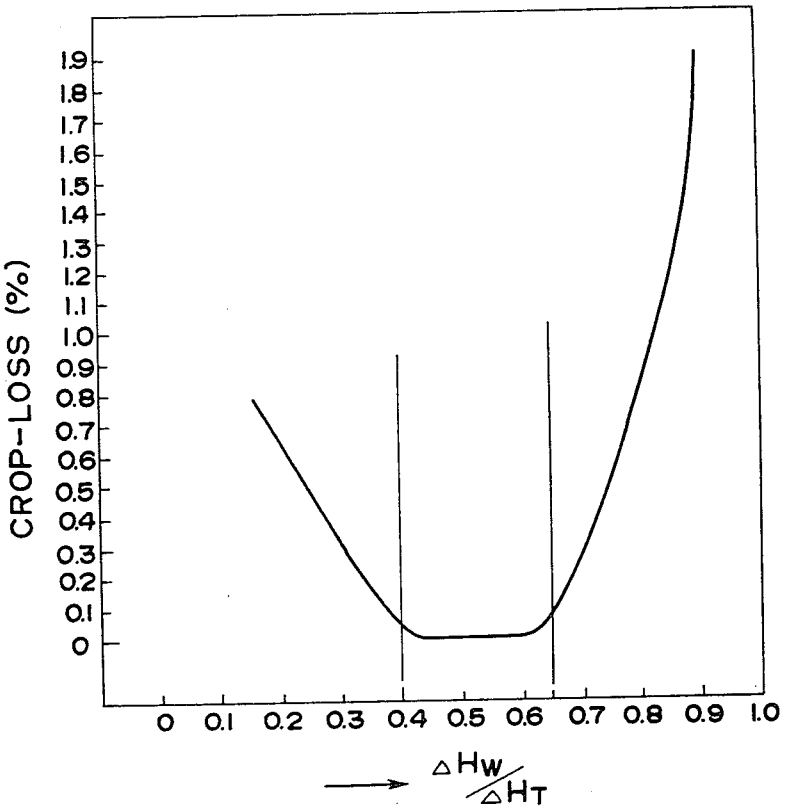
FIG. 12 is a view of correlation showing the effects on the crop loss exerted by the change of $\Delta H_w/\Delta H_T$ in the region of the double barrelling.

According to the results of many experiments conducted by the present inventor, it was ascertained that when $\Delta H_w/\Delta H_T < 0.40$, the example shown in (B) of FIG. 10 is higher in crop loss by 0.3% or more than the example shown in (A) of FIG. 10, when $\Delta H_w/\Delta H_T = 0.15$, the example shown in (B) of FIG. 10 is higher in crop loss by 0.8% than the example shown in (A) of FIG. 10, when $\Delta H_w/\Delta H_T > 0.65$, the example shown in (C) of FIG. 10 is higher in crop loss by 0.5% or more than the example shown in (A) of FIG. 10, and when $\Delta H_w/\Delta H_T = 0.9$, the example shown in (C) of FIG. 10 is higher in crop loss by 1.9% than the example shown in (A) in FIG. 10. FIG. 12 shows the abovedescribed examples illustrated in a graphic chart.

Figure 11:
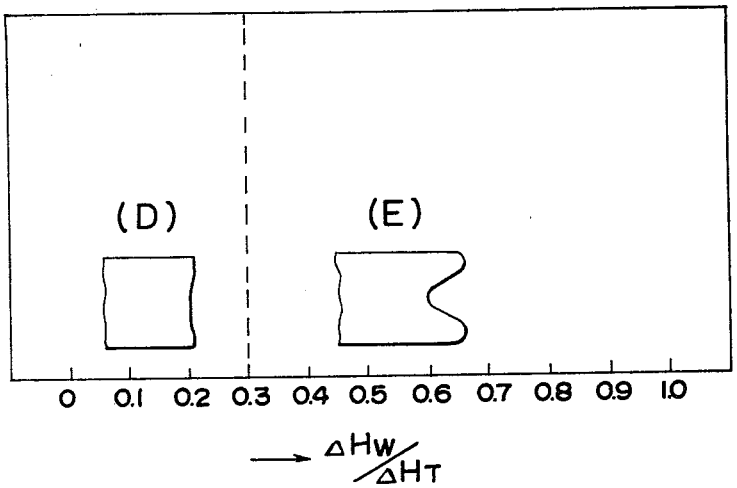
FIG. 11 is an explanatory view showing the relationship between $\Delta H_w/\Delta H_T$ and the planar shape in a region where the side profile of the material due to the thicknesswise reduction presents the single barrelling.

Description will hereunder be given of the reason why $\Delta H_w/\Delta H_T$ is restricted to 0.3 or less in the region of thickness where the single barrelling is presented. As shown in FIG. 11, when $\Delta H_w/\Delta H_T$ is 0.3 or less, the opposite ends of the material in plan view are formed into square, when $\Delta H_w/\Delta H_T$ is larger than 0.3, fishtails are formed at the opposite ends of the material, whereby crop loss increases by 0.5% or more as compared with the case where $\Delta H_w/\Delta H_T$ is 0.3% or less.

Figure 13:
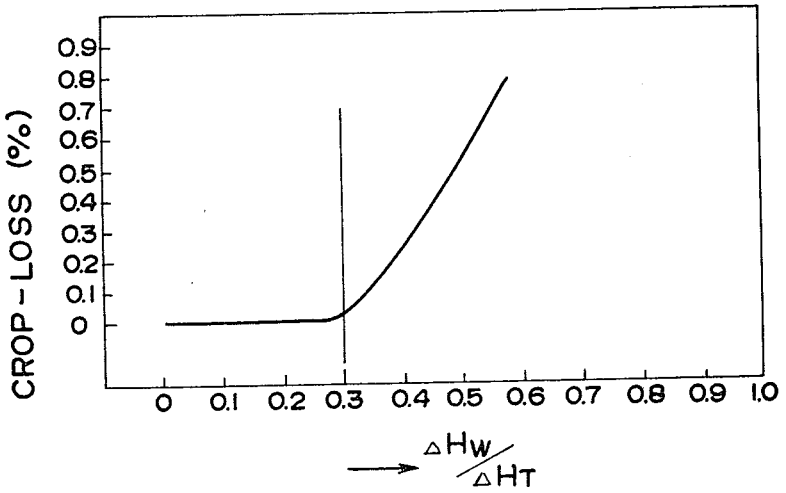
FIG. 13 is a view of correlation showing the effects on the crop loss exerted by the change of $\Delta H_w/\Delta H_T$ in the region of the single barrelling.

FIG. 13 shows the relationship between $\Delta H_w/\Delta H_T$ in the region of the thickness, where the single barrelling is presented, according to the results of the abovedescribed experiments.

As apparent from the results as described above, according to the present invention, $\Delta H_w/\Delta H_T$ is restricted to a range from 0.40~0.65 in the region of the thickness, where the double barrelling is presented, and $\Delta H_w/\Delta H_T$ is restricted to 0.3 or less in the region of the thickness, where the single barrelling is presented.

EXAMPLE

The rolling yield of the prior art and that according to the present invention are compared with each other in producing a slab having a surface of 275 mm by 920 mm from a capped steel ingot weighing 18 tons cast in a mold having a top surface 1200 mm by 782 mm and a bottom surface of 1236 mm by 882 mm.

The following is the rolling method of the prior art. Firstly, a plurality of times of reduction in the widthwise direction (W) is effected to form a steel ingot into one having a width of 1040 mm, the steel ingot is turned through 90° by a manipulator, and reductions in the thicknesswise direction (T) and in the widthwise direction (W) repeatedly alternate with each other, thereby producing the slab having the surface of 275 mm by 920 mm. Table 1 shows the rolling yeild, crop loss and scale loss obtained through the abovedescribed method.

TABLE 1

| | ROLLING YIELD (%) | TOP CROP LOSS (%) | BOTTOM CROP LOSS (%) | SCALE LOSS, ETC. (%) |
|---|---|---|---|---|
| PRIOR ART | 92.6 | 2.9 | 3.7 | 0.8 |

The method according to the present invention was carried out as described below. Since the reduction value for forming a steel ingot into a slab is large in this case, the recesses in the thicknesswise direction (T) and the widthwise direction (W) at the opposite ends of the slab were formed in two forming times including the region of thickness, where the double barrelling is presented, and the region of thickness, where the single barrelling is presented. The details were as shown below. Firstly, the following preliminary rolling was effected for removal of tapering of the steel ingot in the widthwise direction and removal of scales. A reduction in the widthwise direction (W) as a first pass of rolling was effected from the bottom to the top of the material under such a slight reduction value as to merely remove tapering with the width being 1200 mm. Thereafter, the material was turned through 90° by a minipulator, and reduction in the thicknesswise direction (T) was effected, from which process really began the forming of the recesses and the thicknesswise reduction according to the method of the present invention.

More specifically, in order to improve bite-in characteristics of the rolling rolls, the thickness of the bottom of the material should be decreased to 830 mm. To do this, the material was rolled from the bottom to the top, and then, recesses were formed at the bottom of the material in the thicknesswise direction (T). In this case, the recesses were formed by a plurality of times of bite and reverse rolling. The depth $\Delta H_T$ and the length $\Delta L$ of the recesses as shown in FIG. 5 were determined as follows: $\Delta H_{TB}=160$ mm and $\Delta L_B \approx 400$ mm, where a suffix B indicates the Bottom.

Subsequently, recesses were formed in the thicknesswise direction of the top of the material, while the material was subjected to ordinary rolling in the thicknesswise direction from the top to the bottom of the material. In this case, the recesses were formed such that $\Delta H_{TT}=90$ mm and $\Delta L_T \approx 300$ mm, where suffixes TT indicate Thicknesswise direction and Top, respectively. Through this process, the thickness at the center of the material was decreased to 620 mm. At this time, the side profile presented the double barrelling as shown in FIG. 6A. However, this double barrelling was as slight as that the double barrelling can be flattened away by the subsequent widthwise reduction.

Thereafter, in order to increase the value of widthwise reduction per pass, the material was turned through 90° again and subjected to the recess forming in the widthwise direction and the widthwise reduction. The recesses in the widthwise direction at the bottom were formed such that $\Delta H_{wB}=90$ mm and $\Delta L_B \approx 400$ mm, where a suffix W indicates Widthwise direction, B indicates Bottom, by the widthwise reduction from the top to the bottom of the material. In this case, no metal flows to the crop ends were not generated because the metal flows were absorbed by the recesses. At this time, the width of the material was decreased to 1020 mm.

In the abovedescribed region of thickness, where the double barrelling is presented, $\Delta H_w/\Delta H_T=0.62$ at the top side and $\Delta H_w/\Delta H_T=0.56$ at the bottom side.

Subsequently, the material was turned through 90° by the manipulator, subjected to the thicknesswise reduction, and the thickness of the material was decreased to 510 mm. At this time, the side profile of the material presented the single barrelling. Thereafter, recesses in the thicknesswise direction were formed at opposite ends of the top and the bottom, respectively.

The recesse were formed such that $\Delta H_T=125$ mm and $\Delta L_T \approx 400$ mm, respectively.

Subsequently, the material was subjected to one pass reduction in the thicknesswise direction to be reduced in thickness to 450 mm. Then, recesses in the widthwise direction are formed at the top such that $\Delta H_w=35$ mm and $\Delta L_w=300$ mm. Thereafter, the material was subjected to the widthwise reduction from the bottom to the top to be reduced in width to 950 mm.

In the region of thickness, where the side profile of the material presents the single barrelling, $\Delta H_w/\Delta H_T$ at the top and the bottom were 0.28, respectively.

Thereafter, the material was subjected to several passes of ordinary rolling so as to finally obtain the slab having the surface of 275 mm by 920 mm.

Table 2 shows the comparison between the results obtained according to the present invention and the results obtained by the prior art as shows in Table 1 in the rolling yield, crop loss and scale loss.

TABLE 2

| | ROLLING YIELD (%) | TOP CROP LOSS (%) | BOTTOM CROP LOSS (%) | SCALE LOSS, ETC. (%) |
|---|---|---|---|---|
| PRESENT INVENTION | 97.5 | 0.8 | 0.9 | 0.8 |
| PRIOR ART | 92.6 | 2.9 | 3.7 | 0.8 |

As apparent from Table 2, the method according to the present invention achieved considerably reduced crop loss as compared with the prior art, thus resulting in improvements in the rolling yield by 4.9%.

As evident from the abovedescribed example, according to the present invention, during slabbing of a steel ingot, recesses in the thicknesswise and widthwise directions are formed by means of rolling rolls on a pair of opposite surfaces at least at each end of the top and bottom of said steel ingot, and further, the ratio between the widthwise reduction value and the thicknesswise reduction value for forming the recesses at the forward and rear end portons is regulated to 0.40~0.65 in a region of thickness of more than 450~500 mm where the side profile of the material due to the thicknesswise reduction presents a double barrelling and the value in a region of thickness of less than 450~500 mm where the side profile presents a single barrelling is regulated to 0.3 or less, so that fishtails can be prevented from growing to an extreme extent, thereby enabling to improve the rolling yield by about 5% as compared with the prior art.

Moreover, forming of recesses by the method of the present invention can be effected according to the rolling schedule and within short period of time, thus rendering little influence on the productivity.

Furthermore, the method of the present invention can be effected by use of the existing facilities, so that the work can be very easily executed.

What is claimed is:

1. A process for preventing growth of fishtails during slabbing of a steel ingot effected by a reversible rolling mill, including a step of forming recesses at least on a pair of opposite surfaces at least at either the top or bottom of said steel ingot by use of rolling rolls, wherein said process further includes a method of forming recesses in the thicknesswise and widthwise directions, and the ratio between the widthwise reduction value and the thicknesswise reduction value for forming said recesses is regulated to 0.40~0.65 in a region where the side profile of the material due to the thicknesswise reduction presents a double barrelling and the value in a region where said side profile presents a single barrelling is regulated to 0.3 or less.

2. A process for preventing growth of fishtails during slabbing as set forth in claim 1, wherein, firstly said recesses are formed in the thicknesswise direction of the material and then ordinary thicknesswise reduction rolling is effected, and secondly said recesses are formed in the widthwise direction and thereafter ordinary widthwise reduction rolling is effected.

3. A process for preventing growth of fishtails during slabbing as set forth in claim 1, wherein, said recesses are formed in plural number of times in rolling schedule in the thicknesswise and widthwise directions.

4. A process for preventing growth of fishtails during slabbing as set forth in claim 1, the length of each recess is from 200~400 mm.

* * * * *